US005558491A

United States Patent [19]

Andrews

[11] Patent Number: 5,558,491

[45] Date of Patent: Sep. 24, 1996

[54] UNITIZED PRODUCT SEAL FOR PUMPS

[76] Inventor: Darrell G. Andrews, 1627 E. Everglade, Odessa, Tex. 79762

[21] Appl. No.: 414,028

[22] Filed: Mar. 31, 1995

Related U.S. Application Data

[63] Continuation-in-part of Ser. No. 123,080, Sep. 17, 1993, abandoned.

[51] Int. Cl.[6] ..... F04D 29/12

[52] U.S. Cl. ..... 415/111; 415/113; 415/229; 415/230; 415/231; 277/35; 277/50; 277/105; 277/153

[58] Field of Search ..... 415/110–113, 170.1, 415/174.2, 229, 230, 231; 384/477, 484; 277/35, 37, 50, 105, 110, 152, 153

[56] References Cited

U.S. PATENT DOCUMENTS

| | | | |
|---|---|---|---|
| 3,711,218 | 1/1973 | Kennel et al. | 415/229 |
| 3,796,510 | 3/1974 | Korrenn et al. | 384/477 |
| 5,174,583 | 12/1992 | Orlowski et al. | 277/53 |

FOREIGN PATENT DOCUMENTS

| | | | |
|---|---|---|---|
| 0500739 | 11/1954 | Italy | 415/174.2 |
| 0599095 | 3/1948 | United Kingdom | 384/477 |
| 1038019 | 8/1966 | United Kingdom | 277/153 |

*Primary Examiner*—Edward K. Look
*Assistant Examiner*—Christopher Verdier
*Attorney, Agent, or Firm*—Milburn & Peterson, P.C.

[57] ABSTRACT

A unitized roller-seal for sealing centrifugal pump shafts which may be readily repaired and maintained in the field or plant. The unitized roller-seal includes a housing having a bore therethrough with an inner radial flange, a sealed roller bearing seated within the bore on one side of the radial flange within the housing, a lip seal member seated within the bore on the other side of the inner radial flange within the housing. The unitized roller-seal is secured and sealed to the pump casing. The pump shaft is rotatably supported in a sealed bearing housing, and extends through the roller bearing and lip seal member of the roller-seal such that the roller-seal stabilizes the shaft juxtaposed to the sealing surface where the lip seal member engages the shaft. The shaft may have an integral sleeve extending within the unitized roller-seal with a hard coated surface for engagement by the lip seal member.

6 Claims, 3 Drawing Sheets

UNITIZED PRODUCT SEAL FOR PUMPS

This Application is a Continuation-In-Part of application Ser. No. 08/123,080, filed Sep. 17, 1993, now abandoned by Darrell G. Andrews, Applicant, entitled Unitized Product Seal for Pumps.

BACKGROUND OF THE INVENTION

The present invention relates to a mechanical seal system for centrifugal process and transfer pumps, and more particularly to such pumps which include a stuffing box and packing gland.

Generally, the sealing of pumps and shafts has been by mechanical seals. A typical mechanical seal would include a stationary sealing ring sealed by an o-ring gasket to the housing and a spring loaded sealing member secured to the shaft or a sleeve on the shaft that rotates with the shaft. The rotating sealing member is usually spring loaded in some fashion to insure that as the sealing surfaces wear the spring will keep the rotating sealing member engaged with the stationary sealing ring. Such mechanical seals are frequently used to seal stuffing boxes of process and transfer pumps in various industries including oil and gas operations, chemical process, food process and others.

Sealing pumps and turbine shafts from products being pumped becomes extremely important with many new designs of pumps and turbines running at higher speeds, pressures and temperatures thus exacerbating the problems of high maintenance costs, loss of products safety and environmental protection.

Some mechanical seals utilize a soft material spring-loaded against a harder surface with one of the sealing materials stationary and the other rotating with the shaft being sealed. As the soft material wears away the spring constantly urges the soft material against the hard surface. If the spring can no longer maintain engagement between the soft material and the hard surface the seal is lost. Also, if the soft sealing material wears away it may break or leak even though the spring has sufficient biasing force. As solutions to these problems, various sealing arrangement have been proposed and developed which include both labyrinth seals and lip seals for sealing bearing housings to shafts to prevent lubricants from moving outside of the housing along the shaft and to eliminate the movement of contaminates into the bearing areas and lubricant within the housing.

U.S. Pat. Nos. 4,022,479; 4,466,620; and 4,706,968 all granted to David C. Orlowski disclose the improvements made in labyrinth seals. Typically, in the labyrinth seal of Orlowski one part of the mechanical labyrinth seal is affixed to the shaft and one part of the seal is affixed to the housing. The interface or point of mesh between the two parts of the mechanical seal is often designed to provide a labyrinth or tortuous path at the point of close proximity with the object of obtaining a seal between the housing and shaft.

The sealing arrangement described in Pat. No. 4,706,968 of Orlowski is designed to aid in overcoming axial displacement which would cause problems with the two piece labyrinth mechanical seal.

U.S. Pat. No. 4,337,951 granted to Perego discloses another mechanical seal which includes a labyrinth, as well as, an end face seal in which pressure is used to cause the sealing member to engage the sealing surface.

An automobile water pump using a lip seal is disclosed in U.S. Pat. No. 4,921,260. The purpose of this seal is to prevent the generation of abnormal sounds and provide a good sealing effect for a water pump. Primarily, Tankenaka is concerned with eliminating resonant parts such as coil springs of conventional sealing devices in order to prevent the generation of abnormal noises. He also describes that a lip type sealing device is known in sealing an automotive compressor which uses no coil springs.

Another patent, U.S. Pat. No. 2,990,220 to Malone discloses a lip seal for the track rollers on a track laying vehicle to avoid foreign material getting into the bearing and to retain the grease in the bearing.

U.S. Pat. No. 4,572,517 of Rockwood discloses a labyrinth ring seal and housing mounting means which are alleged improvements in labyrinth ring seals. Rockwood provides a stationary sealing ring and a rotating sealing ring having several different diameter walls which mate with each other to prevent lubricant from moving from the housing and to prevent material tending to enter the housing.

Italian Patent No. 500,739, issued to Valentini discloses a sealing arrangement for a centrifugal pump. It describes a spring-loaded clutch plate engaging a collar. The collar is stationary relative to the shaft while the clutch plate rotates with the shaft and the collar gasket is worn away to maintain the seal. The need for replacement of this gasket is indicated by its expulsion through the discharge outlet. A seal cage consisting of a leather gasket contained in a metal sleeve protects the ball bearing supporting the shaft from contamination.

British Patent No. 1,038,019 discloses a shaft sleeve of copper which is covered with a thin layer of hard chromium.

U.S. Pat. No. 3,796,510, issued to Korrenn discloses a shaft mounting for water pumps with two sets of frustoconical bearing rollers for supporting the shaft and are sealed at each end to confine the bearing lubricant therein. An elastic sealing ring is provided to help contain the working fluid of the pump from traveling down the shaft. The bushing containing the frustoconical bearings abuts one side of the collar and the elastic sealing ring abuts the other side of the collar to help contain the working fluid of the pump. The collar is vented to the atmosphere to discharge any working fluid leaking past the seal.

U.S. Pat. No. 3,711,218, issued to Kennel et al discloses a centrifugal pump having a housing section surrounding the impeller of the pump. The housing has a body portion which comprises a sealing device or stuffing box through which extends the impeller shaft. A bearing section connected to the housing section has a pair of spaced apart ball bearings which support the impeller shaft for rotation. It will be observed that no roller bearing is contained within the stuffing box which illustrate some kind of packing around the shaft therein.

However, all of the designs still suffer the problems associated with shaft whip or lack of concentricity between the shaft and the seal at the sealing surface. Consequently the seals suffer excessive wear and require frequent maintenance.

SUMMARY OF THE INVENTION

The present invention provides a unitized seal and shaft bearing or roller-seal for centrifugal process and transfer pumps which is readily repaired and maintained in the field or plant. The unitized roller-seal of the present invention maintain the pump shaft as concentric as possible at the point where the seal engages the hardened or hard coated area of the rotary shaft or sleeve member.

It will be appreciated that the present invention has unique advantages not previously provided for sealing pumps to avoid product loss or contamination. The rotary shaft of the pump is provided with a roller bearing juxtaposed to the sealing surface of the pump shaft or sleeve thereon which stabilizes the pump shaft improving concentricity of the pump shaft and seal. This arrangement provides for longer service life of the seal even at high temperatures and pressures by maintaining a high degree of concentricity between the shaft and the seal at the point of contact of the seal with a hard coated area of the shaft or shaft sleeve.

The unitized roller-seal is of such design that it fits in the packing gland of a centrifugal process or transfer pump, hence the shaft has roller bearing support at the packing gland with a lip seal adequate to prevent the pumped product from leaking along the shaft of the pump out of the stuffing box and gland into the atmosphere or onto the ground. Of course, the packing gland is sealed with an o-ring against the stuffing box.

The present invention reduces the degree of shaft whip which increases the seal life and reduces maintenance cost and provides a seal that is relatively simple to service at the installation site.

DESCRIPTION OF PREFERRED EMBODIMENT

Figure 1:
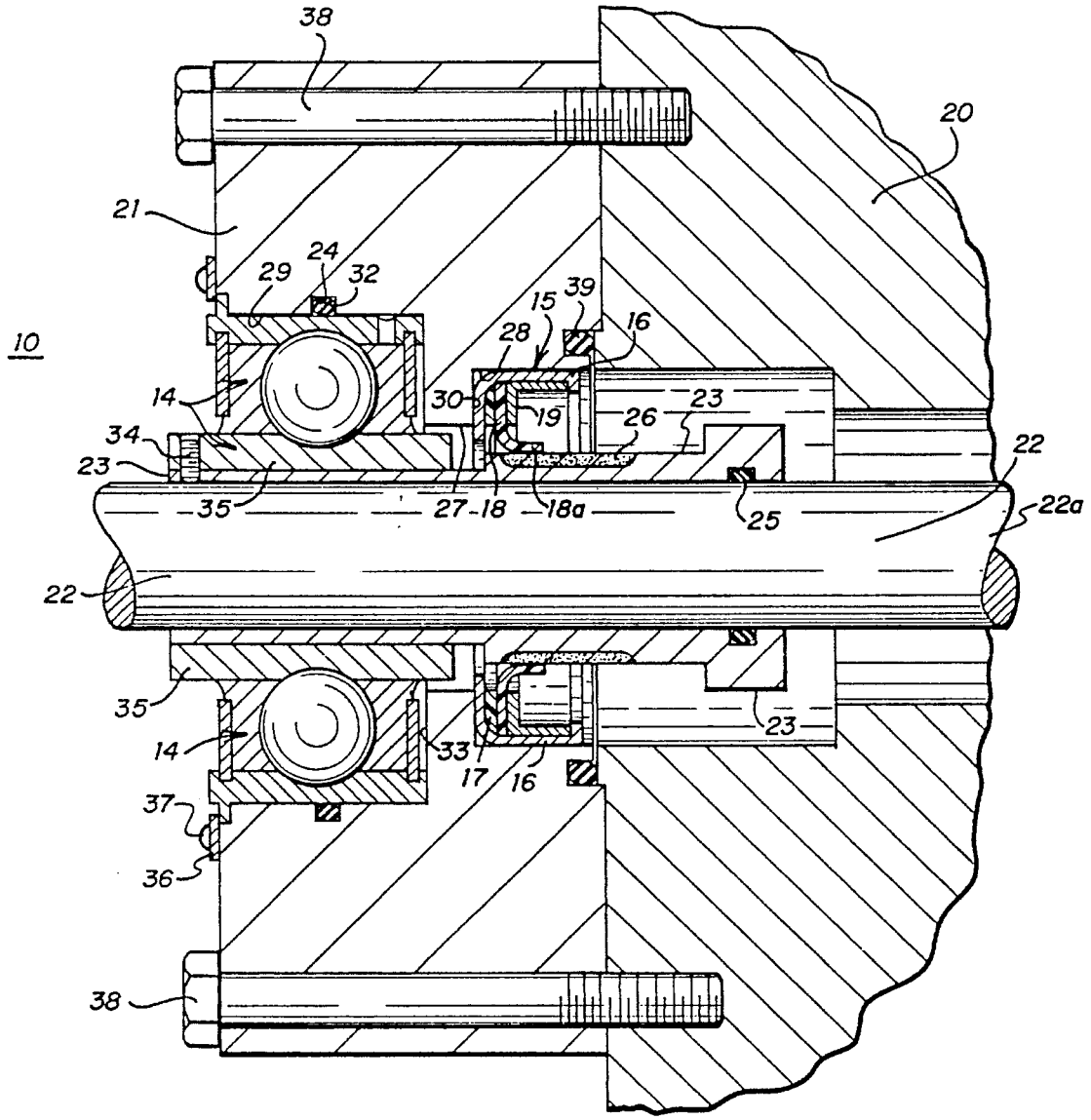
FIG. 1 is a sectional view of a packing gland and partial pump stuffing box illustrating the present invention with roller bearings.
Figure 2:
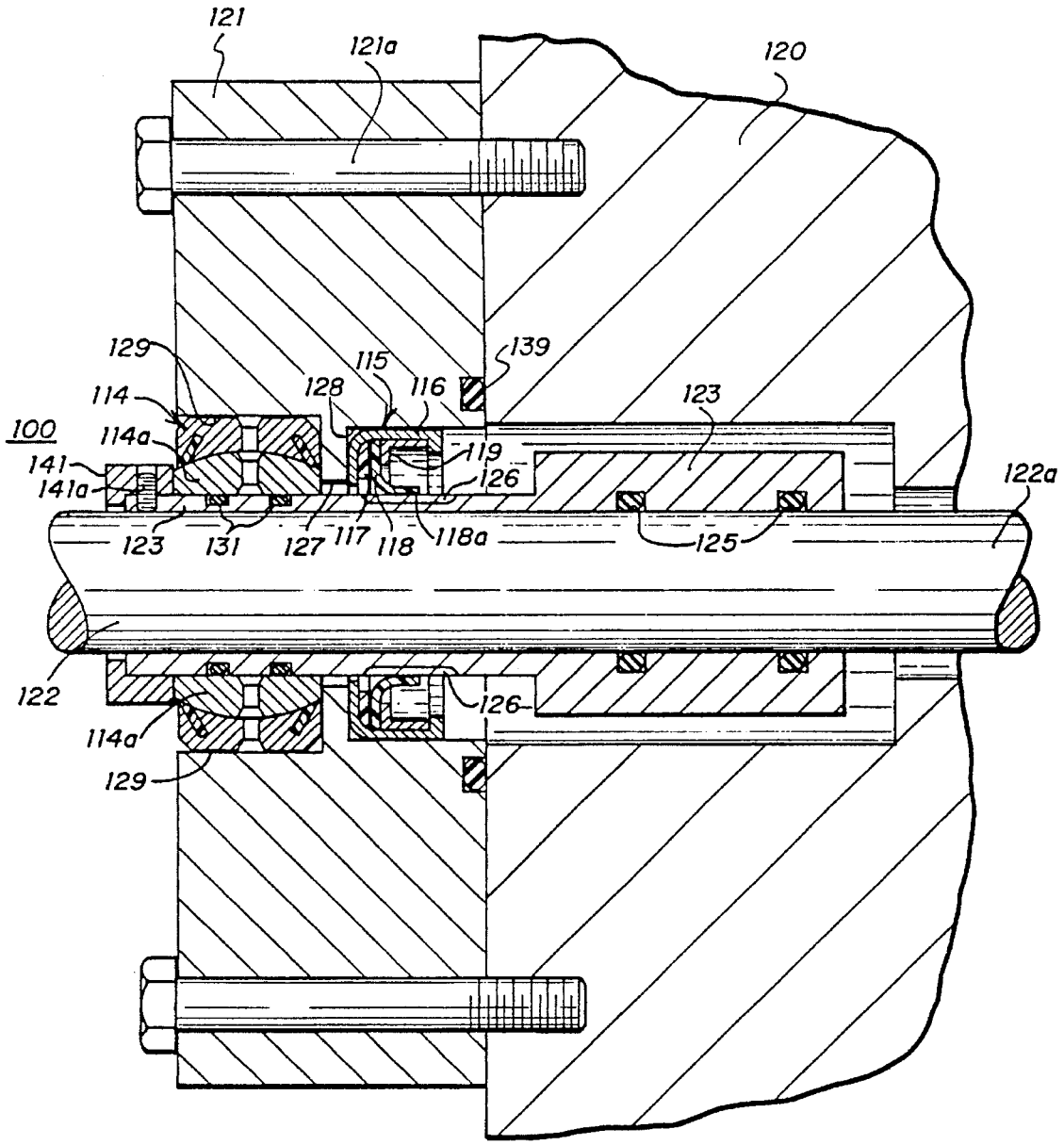
FIG. 2 is a sectional view of a packing gland and partial pump stuffing box illustrating the present invention with a spherical plain bearing.

Referring now to the drawings, FIG. 1 illustrates the present invention using a roller bearing and FIG. 2 illustrates the invention using a spherical plain bearing. Referring now particularly to FIG. 1, roller-seal 10 includes a sealed roller bearing 14 and pressure lip seal 15 which will be described in more detail hereafter. As illustrated in FIG. 1, a pump stuffing box or casing 20 and packing gland or housing 21 of a pump surround a shaft 22 on which is attached an impeller (not shown) within the pump casing. The pump shaft 22 bearings are not shown.

A sleeve 23 is secured to the shaft 22 by o-ring 25 and rotates with the shaft 22. The sleeve 23 has a hard coated surface 26. The gland or housing 21 has a bore 27, a counterbore 28 and a counterbore 29. Counterbore 28 and bore 27 form a shoulder 30. Retained within counterbore 28 against shoulder 30 is pressure lip seal 15 which may be of various constructions. As illustrated, pressure lip seal 15 includes an outer shell 16, gasket 17, sealing member 18 and inner shell 19. Sealing member 18 of lip seal 15 engages hard coated surface 26 with the inner radial skirt 18*a* of sealing member 18 extending along hard coated surface 26 toward the impeller end 22*a* of shaft 22.

Bore 27 and counterbore 29 form a shoulder 33. Counterbore 29 has a circumferential channel 24. Sealed roller bearing 14 is seated within counterbore 29 and is sealed to gland or housing 21 by o-ring 32 in circumferential channel 24. The sealed roller bearing 14 is secured in the gland 21 by washers 36 and screws 37. The inner race 35 of sealed roller bearing 14 is secured to sleeve 23 by set screws 34 for rotation with sleeve 23. The gland 21 is secured to the stuffing box or casing 20 by bolts 38 and sealed against the stuffing box or casing 20 by o-ring 39.

Figure 3:
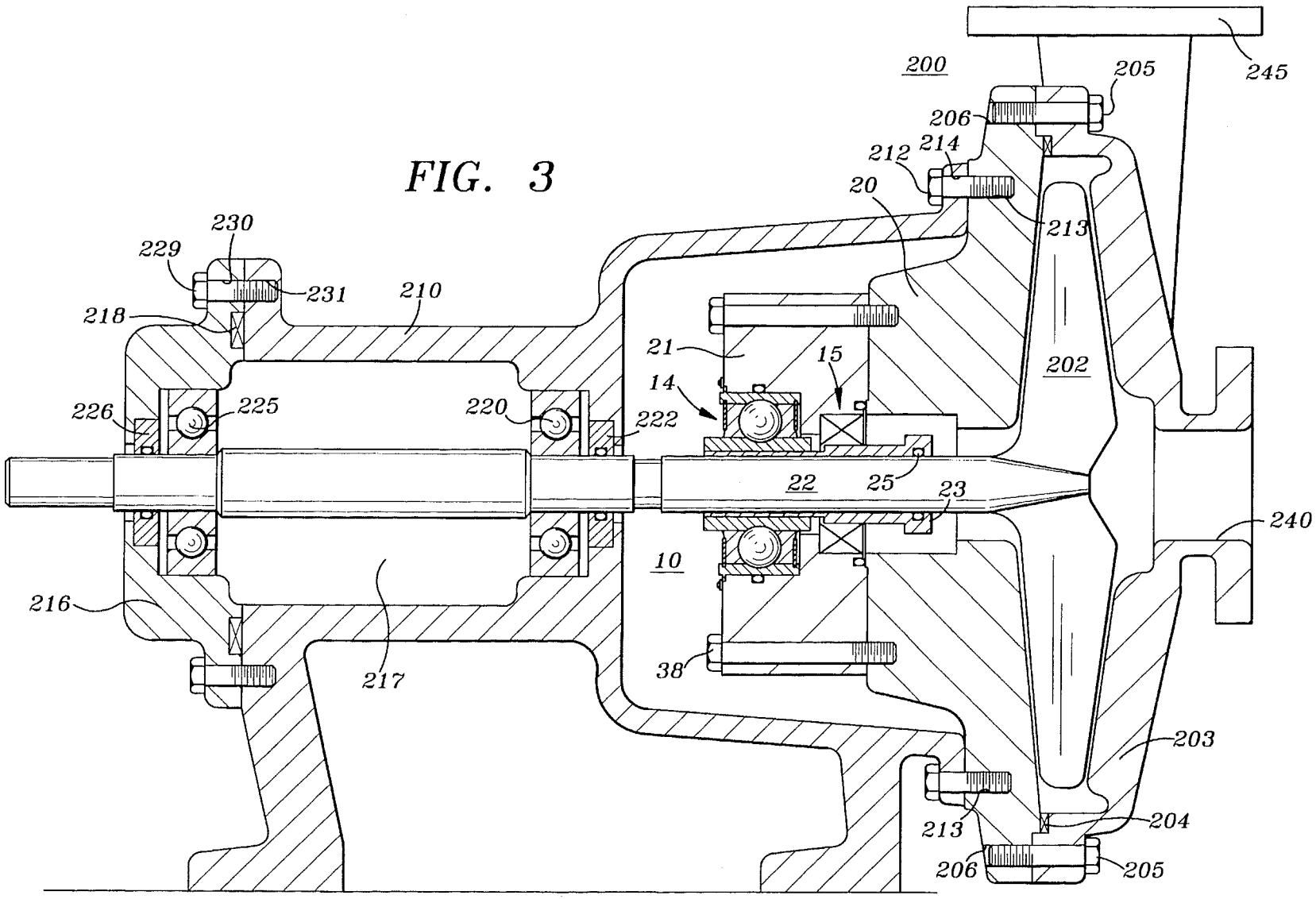
FIG. 3 is a sectional view illustrating the present invention in a centrifugal pump, with a bearing housing, stuffing box housing and packing gland.

In operation, the shaft 22 rotates in the pump bearings with the impeller pumping fluid (see FIG. 3 which illustrates the application of the invention in centrifugal pump 200). Any shaft whip is eliminated or substantially reduced where the lip seal 15 engages the hard coated surface 26 of sleeve 23 by the juxtaposed sealed roller bearing 14 with its inner race 35 secured to sleeve 23.

Referring to FIG. 2, a similar roller-seal arrangement is disclosed illustrating a spherical plain bearing. The roller-seal 100 includes a steel-on-steel spherical plain bearing 114 and a pressure lip seal 115 which will be described in more detail hereafter. A pump stuffing box or casing 120 and packing gland or housing 121 for the pump are illustrated in FIG. 2. A pump shaft 122 has a sleeve 123 secured to the pump shaft 122 by o-rings 125 such that the sleeve 123 rotates with the pump shaft 122. The sleeve 123 has a hard coated area 126. Sleeve 123 has a pair of o-rings 131 thereon which seal the inner race 114*a* of spherical plain bearing 114 for rotation with pump shaft 122. A drive collar 141 secured to sleeve 123 by a set screw 141*a* insures the rotation of inner race 114*a* with sleeve 123. Gland or housing 121 has a bore 127, a counterbore 128 and a counterbore 129. The drive collar 141 retains the inner race 114*a* of spherical roller bearing 114 in counterbore 129.

The pressure lip seal 115 is force fitted in counterbore 128. The pressure lip seal 115 is identical with pressure lip seal 15 and includes an outer shell 116, gasket 117, sealing member 118 and inner shell 119. The inner radial skirt 118*a* of sealing member 118 engages hard coated surface 126 extending towards the impeller end 122*a* of pump shaft 122. Gland or housing 121 is secured to the pump stuffing box or casing 120 by bolts 121*a* and o-ring 139 seals gland or housing 121 to the pump stuffing box or casing 120.

In operation, the shaft 122 rotates in the pump bearings (not shown) with the impeller (not shown) pumping fluid. The roller-seal 100 stabilizes the shaft 122 juxtaposed the sealing surface hard coated area 126. It is apparent that the roller-seal 100 using the spherical plain bearings 114 may be used in centrifugal pump 200 illustrated in FIG. 3.

Referring now to FIG. 3, the roller seal of FIG. 1 is illustrated in a centrifugal pump embodiment having a bearing housing, stuffing box and packing gland.

Referring now in particular to FIG. 3, the roller seal 10 is utilized in centrifugal pump 200. The pump 200 includes an impeller 202 mounted on shaft 22. Volute or cover 203 is secured to stuffing box or casing 20 by a series of bolts 205 in threaded bolt holes 206. A gasket 204 is provided between volute 203 and casing 20. Volute 203 of centrifugal pump 200 has a fluid inlet 240 and a fluid discharge 245.

Bearing housing 210 supports stuffing box or casing 20. The stuffing box or casing 20 is secured to the bearing housing 210 by bolts 212 in threaded bores 213 mated with apertures 214 of bearing housing 210. Thrust bearing cap 216 is secured to bearing housing 210 by bolts 229 which extend through apertures 230 and threaded into bores 231 of bearing housing 210. A gasket 218 is provided between bearing housing 210 and bearing cap 216. Bearing housing 210 and thrust bearing cap 216 form lubricating cavity 217. Rigidly supported in bearing housing 210 is roller bearing 220. Rigidly mounted in thrust bearing cap 216 is thrust roller bearing 225. Shaft 22 extends through bearing housing 210 and is mounted for rotation in roller bearing 220 and thrust roller bearing 225. Roller bearing 220 is sealed by seal 222 to shaft 22. Thrust bearing 225 is sealed by seal 226 in thrust bearing cap 216. It will be understood that seal 222 and seal 226 protect roller bearing 220 and thrust roller bearing 225, respectively, from outside contaminants entering roller bearing 220, thrust roller bearing 225 and lubricating cavity 217.

Roller-seal 10 is fully described in connection with FIG. 1. It will be understood that roller-seal 10 includes roller bearing 14 which is affixed to sleeve 23 which is secured to shaft 22 by o-ring 25. Lip seal 15 seals against sleeve 23 and consequently, shaft 22 to prevent fluid being pumped by impeller 202 from escaping into roller bearing 14 and thus, into the environment.

It will be understood that other roller type sealed bearings and seals other than lip seals may be used depending on space limitation in the particular pump application so long as the roller bearing is juxtaposed to the seal in order to stabilize the pump shaft near the sealing surface.

What is claim is:

1. In a centrifugal pump having a pump shaft and a packing gland, a unitized roller-seal for sealing the pump shaft to the packing gland of the centrifugal pump comprising:

the packing gland having a bore therethrough and an inner radial flange within said bore;

a sealed roller bearing positioned in said packing gland on one side of said radial flange, having an outer race secured to and stationary with said packing gland and an inner race secured to the pump shaft for rotation therewith;

a sleeve having a hard surface secured to the pump shaft positioned in said packing gland with the hard surface on the side of said radial flange opposite said sealed roller bearing; and a seal member fitted within said packing gland on the side of said radial flange opposite said sealed roller bearing, said seal member including a sealing face for engagement with the hard surface of the sleeve juxtaposed said roller bearing.

2. The unitized roller-seal of claim 1 wherein said seal member is a lip seal.

3. In a centrifugal pump having a stuffing box and a packing gland with a bore therethrough sealed to the stuffing box and including a pump shaft, having a sleeve with a hardened sealing surface, extending through the packing gland and stuffing box with an impeller at one end for pumping fluid, the improvement comprising:

a sealed roller bearing having an inner race and an outer race retained within the bore of the packing gland outboard to the stuffing box, said outer race stationary with the packing gland, and said inner race secured to the drive shaft for rotation therewith;

a seal member retained within the bore of the packing gland inboard to the stuffing box, said seal member stationary with the packing gland and in sealing engagement with the hardened sealing surface on the sleeve.

4. The apparatus of claim 3 wherein said seal member is a lip seal.

5. A sealing system for a centrifugal pump having a pump casing and a rotary shaft, including a sleeve with a hardened sealing surface secured thereon, with an impeller mounted at one end within the pump casing comprising:

a housing sealed to the pump casing, said housing having a bore therethrough to receive the rotary shaft therein;

said sleeve secured to the rotary shaft with the hard surface within said housing;

a sealed roller bearing having an outer race and an inner race fitted within said housing outermost from the pump casing with the outer race stationary in said housing and the inner race secured to the sleeve and rotary shaft for rotation therewith; and a seal member fitted in said housing juxtaposed to the sealed roller bearing innermost to the pump casing for sealing engagement with the hardened sealing surface of the sleeve.

6. The sealing system of claim 5 wherein said seal member is a lip seal.

* * * * *